US012252845B2

(12) United States Patent
Shi et al.

(10) Patent No.: US 12,252,845 B2
(45) Date of Patent: Mar. 18, 2025

(54) SOFT AND STRONG TISSUE PRODUCT INCLUDING REGENERATED CELLULOSE FIBERS

(71) Applicant: Kimberly-Clark Worldwide, Inc., Neenah, WI (US)

(72) Inventors: Bo Shi, Neenah, WI (US); Thomas G. Shannon, Neenah, WI (US); Brent M. Thompson, Oshkosh, WI (US); Michael A. Zawadzki, Clemmons, NC (US); Stephen M. Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/620,153

(22) PCT Filed: Jun. 17, 2019

(86) PCT No.: PCT/US2019/037443
§ 371 (c)(1),
(2) Date: Dec. 17, 2021

(87) PCT Pub. No.: WO2020/256684
PCT Pub. Date: Dec. 24, 2020

(65) Prior Publication Data

US 2022/0325476 A1 Oct. 13, 2022

(51) Int. Cl.
*D21H 13/08* (2006.01)
*D21H 15/02* (2006.01)
(Continued)

(52) U.S. Cl.
CPC ..... *D21H 13/08* (2013.01); *D21H 15/02* (2013.01); *D21H 27/005* (2013.01); *D21H 27/38* (2013.01)

(58) Field of Classification Search
CPC ..... D21H 27/005; D21H 13/08; D21H 15/02; D21H 27/38; D21H 27/002; D04H 1/44;
(Continued)

(56) References Cited

U.S. PATENT DOCUMENTS 3,047,455 A 7/1962 Holmes et al.
3,057,772 A 10/1962 Magill, Jr. et al.
(Continued)

FOREIGN PATENT DOCUMENTS

CN 109629110 A 4/2019
EP 0851062 A2 7/1998
(Continued)

OTHER PUBLICATIONS

CFF® Fibrillated Fiber, available at Internet web page "https://web.archive.org/web/20160608223654/http://eftfibers.com/doc/d3.pdf", Jun. 6, 2016, 5 pages.
(Continued)

*Primary Examiner* — Jose A Fortuna
(74) *Attorney, Agent, or Firm* — KIMBERLY-CLARK WORLDWIDE, INC.

(57) ABSTRACT

The present invention provides a wet-laid tissue product comprising regenerated cellulose fibers that can provide 25% or less of the total weight of the wet-laid tissue product. The regenerated cellulose fibers can have a denier of less than 0.9 and a fiber length of less than 6.0 mm. The wet-laid tissue product can provide improvements in softness at a given strength.

18 Claims, 11 Drawing Sheets

(51) Int. Cl.
*D21H 27/00* (2006.01)
*D21H 27/38* (2006.01)

(58) Field of Classification Search
CPC ..... D04H 1/4258; D04H 1/732; D04H 1/26; D04H 1/28; D21F 11/14
See application file for complete search history.

(56) References Cited

U.S. PATENT DOCUMENTS 3,905,863 A 9/1975 Ayers
4,007,083 A 2/1977 Ring et al.
4,565,727 A 1/1986 Giglia et al.
4,755,421 A 7/1988 Manning et al.
4,902,564 A 2/1990 Israel et al.
4,904,343 A 2/1990 Giglia et al.
5,049,235 A 9/1991 Barcus et al.
5,122,407 A 6/1992 Yeo et al.
5,320,710 A 6/1994 Reeves et al.
5,529,665 A 6/1996 Kaun
5,679,218 A 10/1997 Vinson et al.
5,785,813 A 7/1998 Smith et al.
5,935,880 A 8/1999 Wang et al.
6,077,393 A 6/2000 Shannon et al.
6,187,137 B1 2/2001 Druecke et al.
6,197,154 B1 3/2001 Chen et al.
6,277,241 B1 8/2001 Merker et al.
6,727,004 B2 4/2004 Goulet et al.
6,841,038 B2 1/2005 Horenziak et al.
6,861,380 B2 3/2005 Garnier et al.
7,354,502 B2 4/2008 Polat et al.
7,374,638 B2 5/2008 Horenziak et al.
7,396,593 B2 7/2008 Liu et al.
7,449,085 B2 11/2008 Hermans et al.
7,718,036 B2 5/2010 Sumnicht et al.
7,749,356 B2 7/2010 Runge et al.
7,820,010 B2 10/2010 Lostocco et al.
7,867,362 B2 1/2011 Allen et al.
7,935,221 B2 5/2011 Allen et al.
7,972,475 B2 7/2011 Chan et al.
7,972,986 B2 7/2011 Bamholtz et al.
8,057,636 B2 11/2011 Vinson et al.
8,133,353 B2 3/2012 Blanz et al.
8,187,421 B2 5/2012 Sumnicht et al.
8,216,424 B2 7/2012 Bhat et al.
8,225,729 B2 7/2012 MacDonald et al.
8,282,775 B2 10/2012 Mellin et al.
8,334,049 B2 12/2012 Manifold et al.
8,383,235 B2 2/2013 Manifold et al.
8,444,811 B2 5/2013 Dyer et al.
8,513,147 B2 8/2013 Gupta et al.
8,673,116 B2 3/2014 Konishi et al.
8,702,905 B1 4/2014 Hermans et al.
8,753,751 B1 6/2014 Hermans et al.
8,778,505 B2 7/2014 Shannon
8,864,945 B2 10/2014 Miller et al.
9,005,738 B2 4/2015 Baker et al.
9,074,324 B2 7/2015 Shannon et al.
9,267,240 B2 2/2016 Lee et al.
9,282,870 B2 3/2016 Sumnicht et al.
9,314,142 B2 4/2016 Baker et al.
9,655,491 B2 * 5/2017 Sumnicht ..... B08B 1/006
9,661,974 B2 5/2017 Baker et al.
10,045,677 B2 8/2018 Baker et al.
10,301,779 B2 5/2019 Sealey, II et al.
10,450,703 B2 10/2019 Shannon et al.
10,501,892 B2 12/2019 Shannon et al.
10,711,402 B2 * 7/2020 Bailey ..... D21H 27/02
11,421,384 B2 * 8/2022 Rekoske ..... D21H 27/30
11,795,624 B2 * 10/2023 Schulte ..... D21H 27/005
12,012,698 B2 * 6/2024 Tirimacco ..... D21H 27/38
12,163,293 B2 * 12/2024 Shi ..... D21H 27/005
2002/0162635 A1 11/2002 Hsu et al.
2003/0098135 A1 5/2003 Ross et al.
2003/0099821 A1 5/2003 Takai et al.
2004/0084164 A1 5/2004 Shannon et al.
2004/0087237 A1 5/2004 Garnier et al.
2004/0154763 A1 8/2004 Polat et al.
2005/0045293 A1 3/2005 Hermans et al.
2005/0241786 A1 11/2005 Edwards et al.
2006/0289134 A1 12/2006 Yeh et al.
2007/0137808 A1 6/2007 Lostocco et al.
2007/0144697 A1 6/2007 Dyer et al.
2007/0187055 A1 8/2007 Manifold et al.
2007/0224419 A1 9/2007 Sumnicht et al.
2007/0232178 A1 10/2007 Polat et al.
2007/0232180 A1 10/2007 Polat et al.
2007/0254550 A1 11/2007 Hamed et al.
2007/0284069 A1 12/2007 Dyer et al.
2008/0014428 A1 1/2008 Vinson et al.
2008/0173418 A1 7/2008 Sumnicht
2008/0271864 A1 11/2008 Donner et al.
2009/0022983 A1 1/2009 Cabell et al.
2009/0036015 A1 2/2009 Nhan et al.
2011/0104493 A1 5/2011 Barnholtz et al.
2011/0220310 A1 9/2011 Polat et al.
2012/0021178 A1 1/2012 Miller et al.
2012/0302119 A1 11/2012 Clark et al.
2013/0029105 A1 1/2013 Miller et al.
2013/0029106 A1 1/2013 Lee et al.
2013/0071655 A1 3/2013 Zwick et al.
2013/0199741 A1 8/2013 Stage et al.
2013/0216789 A1 8/2013 Kraus et al.
2013/0288556 A1 10/2013 Moore et al.
2014/0096924 A1 4/2014 Rekoske et al.
2014/0311694 A1 10/2014 Clark et al.
2014/0311695 A1 10/2014 Clark et al.
2015/0114580 A1 4/2015 McKee et al.
2015/0173583 A1 * 6/2015 Sumnicht ..... D21H 27/007 134/6
2015/0240426 A1 8/2015 Hermans et al.
2015/0330029 A1 11/2015 Ramaratnam et al.
2016/0145809 A1 5/2016 Hermans et al.
2016/0145810 A1 5/2016 Miller, IV et al.
2016/0227977 A1 * 8/2016 Sumnicht ..... D21H 17/52
2016/0340835 A1 * 11/2016 Lee ..... D21H 11/08
2017/0009401 A1 1/2017 Janese
2017/0070036 A1 3/2017 Derouen
2017/0254023 A1 9/2017 Sumnicht et al.
2017/0306566 A1 * 10/2017 Bailey ..... D21H 27/005
2017/0314207 A1 11/2017 Sealey, II et al.
2017/0328012 A1 * 11/2017 Lee ..... B32B 29/005
2018/0142419 A1 5/2018 Rouse et al.
2018/0142422 A1 5/2018 Baum et al.
2018/0171558 A1 6/2018 Baker et al.
2018/0334778 A1 11/2018 Shannon et al.
2018/0344120 A1 12/2018 Baker et al.
2019/0169798 A1 6/2019 Rouse et al.
2022/0325476 A1 * 10/2022 Shi ..... D04H 1/28
2022/0325479 A1 * 10/2022 Shi ..... D21H 27/005
2023/0026339 A1 * 1/2023 Weigert ..... B32B 5/06
2023/0132722 A1 * 5/2023 Vogt ..... D21H 27/38 162/109
2023/0133946 A1 * 5/2023 Schulte ..... D21H 13/08 162/109
2023/0148320 A1 * 5/2023 Satori ..... D21H 27/02 162/111

FOREIGN PATENT DOCUMENTS

EP 1039024 A1 9/2000
EP 1694915 B1 12/2010
EP 2575580 B1 11/2016
EP 3467171 A1 4/2019
EP 3258824 B1 * 4/2021 ..... A47K 10/16
WO 2013116066 A1 8/2013
WO 2014149616 A1 9/2014
WO 2016122477 A1 8/2016
WO 2016134256 A1 8/2016
WO 2016137492 A1 9/2016
WO WO-2017189665 A1 * 11/2017 ..... D21F 11/006
WO 18063240 A1 4/2018
WO 18156111 A1 8/2018
WO WO-2020256684 A1 * 12/2020 ..... D04H 1/26

(56) References Cited

FOREIGN PATENT DOCUMENTS

| | | | | |
|---|---|---|---|---|
| WO | WO-2020256685 | A1 * | 12/2020 | ..... D04H 1/4258 |
| WO | WO-2023075799 | A1 * | 5/2023 | |
| WO | WO-2023076732 | A2 * | 5/2023 | ..... D21H 13/08 |

OTHER PUBLICATIONS

Gill et al., Lyocell: Properties and Applications, Man-Made Textile in India, Mar. 2002, pp. 93-97.

Bjorquist, Stina et al., "Textile Qualities of Regenerated Cellulose Fibers from Cotton Waste Pulp", Textile Research Journal, Jul. 28, 2017, http://journals.sagepub.com/doi/full/10.1177/0040517517723021.

Kreze, Tatjana et al., "Structural Characteristics of New and Conventional Regenerated Cellulosic Fibers", Textile Research Journal, Aug. 1, 2003, http://journals.sagepub.com/doi/10.1177/004051750307300804.

* cited by examiner

SOFT AND STRONG TISSUE PRODUCT INCLUDING REGENERATED CELLULOSE FIBERS

BACKGROUND OF THE DISCLOSURE

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

Typically when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually comprise layered structures where the low coarseness fibers are directed to the outer layer of the tissue sheet with the inner layer of the sheet comprising longer, coarser fibers.

Unfortunately, the need for softness is balanced by the need for strength. Tissue product strength can be measured by calculating the tensile strength of the tissue product. However, tensile strength of a tissue product is generally inversely related to softness, and thus, the paper maker is continuously challenged with the need to balance the need for softness with the need for strength. Additionally, while tensile strength is one measure of tissue strength, other properties such as tensile energy absorbed (TEA), tear strength, and wet burst strength are also important to strength or durability of the tissue in use.

Thus, there remains a need for improvements in the manufacture of tissue products, which must be both soft and strong.

SUMMARY OF THE DISCLOSURE

The present inventors have created wet-laid tissue products that include regenerated cellulose fibers that surprisingly still provide adequate strength and softness. To produce the instant tissue products the inventors have successfully moderated the changes in strength and softness typically associated with substituting conventional wood papermaking fibers, such as EHWK, with particular regenerated cellulose fibers. Accordingly, in certain preferred embodiments, the invention provides tissue products in which regenerated cellulose fibers replace other fibers of the tissue product without negatively effecting the tissue product's strength and softness.

In one aspect, a wet-laid tissue product is provided that includes regenerated cellulose fibers providing 25% or less of the total weight of the wet-laid tissue product. The regenerated cellulose fibers have a denier of less than 0.9 and a fiber length of less than 6.0 mm.

In another aspect, a wet-laid tissue product is provided that includes regenerated cellulose fibers providing 25% or less of the total weight of the wet-laid tissue product. The wet-laid tissue product includes a TS7 value≤0.0066×GMT+8.0752, wherein the GMT is between about 700 g/3" to about 1300 g/3".

In yet another aspect, a wet-laid tissue product is provided that includes regenerated cellulose fibers providing 25% or less of the total weight of the wet-laid tissue product. The wet-laid tissue product includes a TS750 value≤0.021×GMT+42.663, wherein the GMT is between about 700 g/3" to about 1300 g/3".

BRIEF DESCRIPTION OF THE DRAWINGS

A full and enabling disclosure thereof, directed to one of ordinary skill in the art, is set forth more particularly in the remainder of the specification, which makes reference to the appended figures in which.

DEFINITIONS

Figure 1:
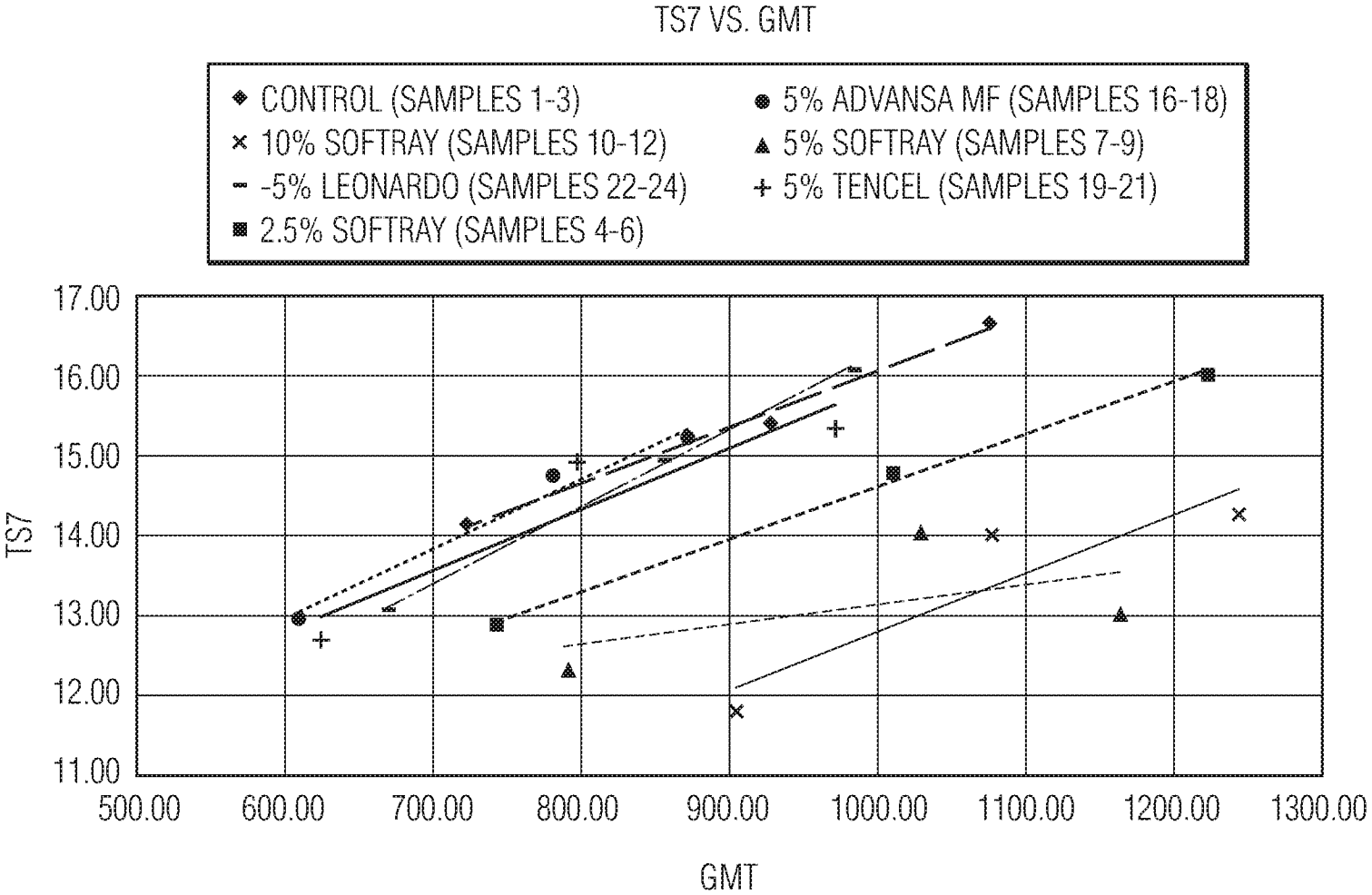
FIG. 1 is a graph illustrating TS7 Softness values versus GMT values for various samples including regenerated cellulose fibers as described herein.

As used herein, the term "tissue product" generally refers to products made from tissue webs and includes various paper products, such as facial tissue, bath tissue, paper towels, napkins, wipers, medical pads, and the like.

As used herein, the term "fiber" means an elongate particulate having an apparent length greatly exceeding its apparent width. More specifically, and as used herein, fiber means such fibers suitable for a papermaking process and more particularly the tissue paper making process.

As used herein, the term "regenerated cellulose" refers to fibers that are derived from cellulose, and more preferably, wood cellulose, that are dissolved, purified, and extruded.

As used herein, the term "synthetic fiber" means a non-cellulosic, thermoplastic fiber.

As used herein, the term "thermoplastic" means a plastic which becomes pliable or moldable above a specific temperature and returns to a solid state upon cooling. Exemplary thermoplastic fibers can include polyesters (e.g., polyalkylene terephthalates such as polyethylene terephthalate (PET), polybutylene terephthalate (PBT) and the like), polyalkylenes (e.g., polyethylenes, polypropylenes and the like), poyacrylonitriles (PAN), and polyamides (nylons, for example, nylon-6, nylon 6,6, nylon-6,12, and the like).

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "Tear" refers to the tear strength as measured according to the Tear test method as described in the test methods section herein.

As used herein, the term "GM TEAR" refers to the Geometric Mean Tear as defined by the following equation:

$$\text{GM TEAR}=\sqrt{MD\text{TEAR}\times CD\text{TEAR}}$$

As used herein, the term "Wet Burst" refers to the peak load wet burst strength (measured in grams force) as calculated according to the Wet Burst Strength test method as described in the test methods section herein.

As used herein, the term "GMM" refers to the square root of the product of the machine direction and cross-machine direction slopes, and is an output of the MTS TestWorks™ in the course of determining the tensile strength as described in the Test Methods section.

As used herein, the term "Geometric Mean Tensile Energy Absorption" (GM TEA) refers to the square root of the product MD TEA and CD TEA, which are measured in the course of determining tensile strength as described below. GM TEA has units of gm*cm/cm$^2$.

As used herein, the term "Durability" is defined by the following equation:

$$\text{Durability} = GM\ \text{TEAR} + GM\ \text{TEA} + \left(\frac{\text{Wet Burst}}{10}\right)$$

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, OR). The micrometer has an anvil diameter of 2.22 inches (56.4 mm) and an anvil pressure of 132 grams per square inch (per 6.45 square centimeters) (2.0 kPa).

As used herein, the term "fiber length" is defined and measured according to the Fiber Length Test as described in the Test Methods section.

As used herein, the term "denier" refers to a unit of measure for the linear mass density of fibers. Fiber denier is to be measured according to ASTM D-1577, "Standard Test Methods for Linear Density of Textile Fibers."

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kg.

As used herein, the terms "geometric mean tensile" and "GMT" refer to the square root of the product of the machine direction tensile strength and the cross-machine direction tensile strength of the web. While the GMT may vary tissue products prepared according to the present disclosure generally have a GMT greater than about 400 g/3", more preferably greater than about 500 g/3" and still more preferably greater than about 600 g/3".

As used herein, the terms "TS7", "TS7 value", "TS750", and "TS750 value" refer to the output of the EMTEC Tissue Softness Analyzer (commercially available from Emtec Electronic GmbH, Leipzig, Germany) as described in the Test Methods section. TS7 and TS750 has units of dB V$^2$ rms, however, TS7 may be referred to herein without reference to units.

As used herein, the term "Stiffness Index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\,\text{Tensile Slope (kg)}\times CD\ \text{Tensile Slope (kg)}}}{GMT(\text{g/3"})}\times 1{,}000$$

DETAILED DESCRIPTION OF THE DISCLOSURE

In the present disclosure, the present inventors have now discovered particular regenerated cellulose fibers (RCF) that can be utilized in a wet-laid tissue product that can provide adequate softness and still maintain proper strength in the tissue product. It has been discovered that substituting particular regenerated cellulose fibers for *eucalyptus* fibers in a wet-laid tissue product can provide a suitable replacement for *eucalyptus* fibers, or even provide an enhancement to *eucalyptus* fibers, for producing characteristics of softness, strength, and/or durability in the wet-laid tissue product. However, it is important to note that not all regenerated cellulose fibers used in place of other fibers, such as *eucalyptus* fibers, will maintain adequate strength, softness, and durability within a tissue product.

For example, Tables 1 and 2 below illustrates testing that produced a variety of wet-laid tissue products through an un-creped through-air dried (UCTAD) process. Table 1 provides a description of the samples that were tested for the various properties listed in Table 2. Single-ply, layered, uncreped through-air dried (UCTAD) tissue web were made generally in accordance with U.S. Pat. No. 5,607,551. The tissue webs and resulting tissue products were formed from various fiber furnishes including, *Eucalyptus* Hardwood Kraft (EHWK) pulp, NBSK pulp, and regenerated cellulose. The regenerated cellulose fibers tested herein included Softray® regenerated cellulose fibers having a 0.54 denier (0.6 dtex) and fiber length of 4.0 mm, available from Daiwabo Rayon Co., Ltd. (Osaka, Japan), Tencel® regenerated cellulose fibers having a 1.26 denier (1.4 dtex) and fiber length of 4.0 mm, available from Lenzing (Lenzing, Austria), and Leonardo® regenerated cellulose fibers having a 2.25 denier (2.5 dtex) and fiber length of 5.0 mm, available from Kelheim Fibers (Germany). Additionally, Advansa® MF fibers comprised of PET synthetic microfibers having a 0.45 denier (0.5 dtex) and fiber length of 3.0 mm, available from ADVANSA Marketing GmbH (Hamm, Germany) were used for comparative purposes to the regenerated cellulose fibers.

The EHWK furnish was prepared by dispersing about 120 pounds (oven dry basis) EHWK pulp in a pulper for 30 minutes at a consistency of about 3 percent. The fiber was then transferred to a machine chest and diluted to a consistency of approximately 1 percent. In certain instances starch (Redibond 2038 A) was added to the EHWK machine chest as indicated in Table 1.

The NBSK furnish was prepared by dispersing about 50 pounds (oven dry basis) of NBSK pulp in a pulper for 30 minutes at a consistency of about 3 percent. The fiber was then transferred to a machine chest and diluted to a consistency of approximately 1 percent. In certain instances starch (Redibond 2038 A) was added to the NBSK machine chest as indicated in Table 1.

The stock solutions were pumped to a 3-layer headbox after dilution to approximately 0.075 percent consistency to form a three layered tissue web. EHWK fibers were disposed on the inner layer and the NBSK and the regenerated cellulose fibers were disposed on the outer two layers. The relative weight percentage of the layers was 30%/40%/30%. The formed web was non-compressively dewatered and rush transferred to a transfer fabric traveling at a speed about 28 percent slower than the forming fabric. The transfer vacuum at the transfer to the TAD fabric was maintained at approximately 6 inches of mercury vacuum to control molding to a constant level. The web was then transferred to a T-1205-2 TAD fabric (commercially available from Voith Fabrics, Appleton, WI and previously disclosed in U.S. Pat. No. 8,500,955, the contents of which are incorporated herein in a manner consistent with the present disclosure). The web was then dried and wound into a parent roll. The parent rolls were then converted into 1-ply bath tissue rolls. Calendering was done with a steel-on-rubber setup. The rubber roll using in the converting process had a hardness of 40 P&J. The rolls were converted to a diameter of about 117 mm with Kershaw firmness target of about 6 mm and a target roll weight of about 400 grams. Samples were produced as described in Table 1 below.

TABLE 1

Sample Descriptions

| Sample No. | Sample Description | % Starch | Basis Wt. (gsm) |
|---|---|---|---|
| 1 | Control - 60% EHWK, 40% NBSK | 0 | 37.90 |
| 2 | Control - 60% EHWK, 40% NBSK | 2.5 | 36.79 |
| 3 | Control - 60% EHWK, 40% NBSK | 6.0 | 36.66 |
| 4 | 57.5% EHWK, 40.0% NBSK, 2.5% Regenerated Cellulose Softray ® (0.54 denier, 4.0 mm fiber length) | 0 | 36.49 |
| 5 | 57.5% EHWK, 40.0% NBSK, 2.5% Regenerated Cellulose Softray ® (0.54 denier, 4.0 mm fiber length) | 2.5 | 37.22 |
| 6 | 57.5% EHWK, 40.0% NBSK, 2.5% Regenerated Cellulose Softray ® (0.54 denier, 4.0 mm fiber length) | 6.0 | 37.18 |
| 7 | 55.0% EHWK, 40.0% NBSK, 5.0% Regenerated Cellulose Softray ® (0.54 denier, 4.0 mm fiber length) | 0 | 36.32 |
| 8 | 55.0% EHWK, 40.0% NBSK, 5.0% Regenerated Cellulose Softray ® (0.54 denier, 4.0 mm fiber length) | 2.5 | 36.43 |
| 9 | 55.0% EHWK, 40.0% NBSK, 5.0% Regenerated Cellulose Softray ® (0.54 denier, 4.0 mm fiber length) | 6.0 | 36.28 |
| 10 | 50.0% EHWK, 40.0% NBSK, 10.0% Regenerated Cellulose Softray ® (0.54 denier, 4.0 mm fiber length) | 0 | 38.11 |
| 11 | 50.0% EHWK, 40.0% NBSK, 10.0% Regenerated Cellulose Softray ® (0.54 denier, 4.0 mm fiber length) | 2.5 | 36.91 |
| 12 | 50.0% EHWK, 40.0% NBSK, 10.0% Regenerated Cellulose Softray ® (0.54 denier, 4.0 mm fiber length) | 6.0 | 37.58 |
| 13 | 55.0% EHWK, 40.0% NBSK, 5.0% Regenerated Cellulose Softray ® (0.54 denier, 4.0 mm fiber length) | 0 | 32.84 |
| 14 | 55.0% EHWK, 40.0% NBSK, 5.0% Regenerated Cellulose Softray ® (0.54 denier, 4.0 mm fiber length) | 2.5 | 33.23 |
| 15 | 55.0% EHWK, 40.0% NBSK, 5.0% Regenerated Cellulose Softray ® (0.54 denier, 4.0 mm fiber length) | 6.0 | 33.91 |

TABLE 1-continued

Sample Descriptions

| Sample No. | Sample Description | % Starch | Basis Wt. (gsm) |
|---|---|---|---|
| 16 | 55.0% EHWK, 40.0% NBSK, 5.0% PET Advansa ® MF (0.45 denier, 3.0 mm fiber length) | 0 | 38.10 |
| 17 | 55.0% EHWK, 40.0% NBSK, 5.0% PET Advansa ® MF (0.45 denier, 3.0 mm fiber length) | 2.5 | 37.25 |
| 18 | 55.0% EHWK, 40.0% NBSK, 5.0% PET Advansa ® MF (0.45 denier, 3.0 mm fiber length) | 6.0 | 37.31 |
| 19 | 55.0% EHWK, 40.0% NBSK, 5.0% Regenerated Cellulose Tencel ® (1.26 denier, 4.0 mm fiber length) | 0 | 36.68 |
| 20 | 55.0% EHWK, 40.0% NBSK, 5.0% Regenerated Cellulose Tencel ® (1.26 denier, 4.0 mm fiber length) | 2.5 | 37.11 |
| 21 | 55.0% EHWK, 40.0% NBSK, 5.0% Regenerated Cellulose Tencel ® (1.26 denier, 4.0 mm fiber length) | 6.0 | 38.01 |
| 22 | 55.0% EHWK, 40.0% NBSK, 5.0% Regenerated Cellulose Leonardo ® (2.25 denier, 5.0 mm fiber length) | 0 | 36.45 |
| 23 | 55.0% EHWK, 40.0% NBSK, 5.0% Regenerated Cellulose Leonardo ® (2.25 denier, 5.0 mm fiber length) | 2.5 | 36.87 |
| 24 | 55.0% EHWK, 40.0% NBSK, 5.0% Regenerated Cellulose Leonardo ® (2.25 denier, 5.0 mm fiber length) | 6.0 | 36.57 |

TABLE 2

Various Properties of the Samples created from Table 1.

| Sample No. | GMT | GMM | GM TEA | GM TEAR | Durability | Wet Burst/10 | TS7 Softness | TS750 Softness | Stiffness |
|---|---|---|---|---|---|---|---|---|---|
| 1 | 722.66 | 5.62 | 7.00 | 9.48 | 27.54 | 11.06 | 14.16 | 62.44 | 0.66 |
| 2 | 927.13 | 5.91 | 10.35 | 12.20 | 33.45 | 10.89 | 15.42 | 68.23 | 2.76 |
| 3 | 1076.25 | 5.65 | 12.26 | 13.89 | 36.56 | 10.40 | 16.69 | 71.04 | 4.37 |
| 4 | 743.71 | 5.51 | 7.59 | 10.91 | 31.46 | 12.96 | 12.90 | 57.01 | 0.21 |
| 5 | 1010.49 | 5.53 | 11.42 | 13.53 | 38.18 | 13.23 | 14.80 | 66.83 | 2.02 |
| 6 | 1223.35 | 5.85 | 15.13 | 15.29 | 43.80 | 13.38 | 16.03 | 66.77 | 3.68 |
| 7 | 790.21 | 5.93 | 8.14 | 11.43 | 36.29 | 16.71 | 12.33 | 57.71 | −0.10 |
| 8 | 1029.69 | 6.31 | 11.69 | 14.04 | 42.15 | 16.42 | 14.05 | 58.40 | 1.62 |
| 9 | 1163.63 | 6.71 | 13.24 | 16.23 | 44.64 | 15.17 | 13.02 | 66.62 | 2.81 |
| 10 | 904.45 | 5.89 | 9.53 | 12.57 | 43.58 | 21.48 | 11.83 | 52.26 | −0.91 |
| 11 | 1077.50 | 6.24 | 11.45 | 15.01 | 44.57 | 18.11 | 14.03 | 59.63 | 1.34 |
| 12 | 1244.34 | 6.91 | 13.83 | 17.35 | 50.96 | 19.78 | 14.28 | 66.57 | 2.16 |
| 13 | 551.54 | 4.82 | 5.72 | 10.09 | 27.96 | 12.15 | 13.22 | 47.63 | −1.97 |
| 14 | 698.17 | 4.94 | 7.51 | 12.19 | 32.20 | 12.50 | 14.84 | 56.86 | 0.65 |
| 15 | 892.27 | 4.86 | 10.82 | 13.87 | 37.56 | 12.87 | 15.79 | 55.85 | 1.26 |
| 16 | 609.96 | 4.11 | 6.70 | 9.34 | 27.52 | 11.48 | 12.98 | 54.69 | −0.75 |
| 17 | 780.88 | 4.97 | 8.76 | 12.86 | 33.36 | 11.74 | 14.76 | 65.59 | 0.90 |
| 18 | 871.65 | 4.98 | 10.65 | 14.23 | 36.46 | 11.58 | 15.23 | 67.88 | 2.47 |
| 19 | 623.72 | 5.11 | 6.42 | 10.27 | 29.86 | 13.17 | 12.70 | 55.04 | 0.00 |
| 20 | 797.63 | 5.20 | 8.98 | 12.36 | 34.86 | 13.52 | 14.94 | 66.97 | 1.38 |
| 21 | 971.35 | 5.65 | 11.15 | 15.64 | 39.21 | 12.41 | 15.36 | 72.24 | 2.94 |
| 22 | 668.24 | 4.67 | 7.21 | 10.58 | 29.91 | 12.11 | 13.08 | 54.79 | −0.52 |
| 23 | 854.39 | 5.08 | 9.83 | 14.22 | 36.00 | 11.95 | 14.97 | 64.86 | 1.53 |
| 24 | 981.65 | 4.72 | 11.50 | 16.16 | 40.07 | 12.41 | 16.09 | 72.37 | 2.31 |

Figure 2:
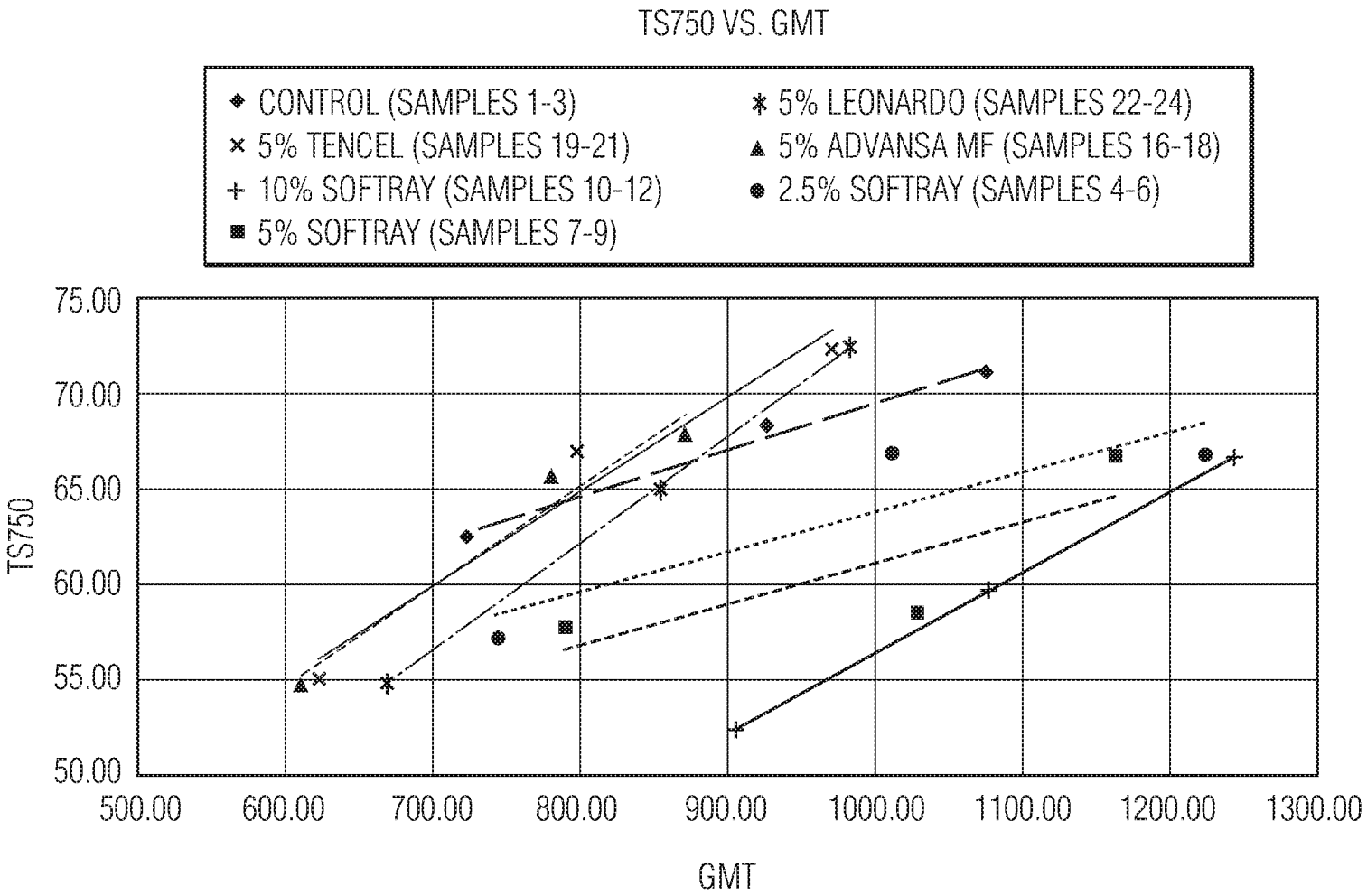
FIG. 2 is a graph illustrating TS750 Softness values versus GMT values for various samples including regenerated cellulose fibers described herein.

FIG. 1 depicts some of the results of the testing for the TS7 values vs. GMT as documented in Table 2 and compares various types of regenerated cellulose. FIG. 2 depicts a similar comparison, but is directed to the test results for the TS750 values from Table 2. As depicted in FIGS. 1 and 2, when comparing the various samples that included 5.0% of regenerated cellulose, but of different denier and/or fiber length. Additionally, FIGS. 1 and 2 illustrate sample nos. 4-6 that include 2.5% of Softray® regenerated cellulose fibers and sample nos. 10-12 that include 10% of Softray® regenerated cellulose fibers for comparative purposes.

As illustrated in FIGS. 1 and 2, the wet-laid tissue products including particular regenerated cellulose fibers in place of EHWK fibers, can include beneficial softness at a given strength as compared to the control samples. In other words, the wet-laid tissue products including particular regenerated cellulose fibers in place of EHWK fibers shift the strength-softness curve to the right by providing increased strength at a given softness, or alternatively, increased softness at a given strength.

Not all samples including regenerated cellulose fibers provided enhanced strength/softness benefits over the control, or at the same magnitude as samples with particular regenerated cellulose fibers. As can be noticed from Table 2 and FIGS. 1 and 2, the samples including regenerated cellulose fibers having a 0.54 denier and 4.0 mm fiber length (samples including Softray® regenerated cellulose fibers) provided significantly improved strength-softness benefits in comparison to the samples including other variations of regenerated cellulose fibers or the PET microfibers (Advansa® MF). The inventors have surprisingly discovered that the denier of the regenerated cellulose fibers provides increased softness at a given strength. Thus, it is preferable for the regenerated cellulose fibers to have a denier of less than 0.9, more preferably less than 0.8, and even more preferably less than 0.7. It is also preferable for the regenerated cellulose fibers to have a fiber length of between 1.4 mm and 6.0 mm. It is preferable for the regenerated cellulose fibers to have a length that is greater than 1.5 mm, more preferably greater than 2.0 mm. However, a maximum fiber length is preferred as fibers too long may create poor formation with standard tissue wet end systems. Thus, the fiber length is preferably less than 6.0 mm, more preferably less than 5.5 mm, and even more preferably less than 5.0 mm.

The wet-laid tissue products including regenerated cellulose fibers can include a GMT greater than 600.0 g/3", more preferably greater than 700.0 g/3", and even more preferably greater than 800.0 g/3". The wet-laid tissue products including regenerated cellulose fibers can include a TS7 value of less than 16.00. The wet-laid tissue products including regenerated cellulose fibers can include a TS750 value of less than 67.00.

In particular, the TS7 value and TS750 values from Table 2 and as illustrated in FIGS. 1 and 2 can be quantified in terms of a given GMT for samples including the particularly beneficial regenerated cellulose fibers. For example, an equation for calculating the TS7 value can be generated based on the trend line provided by sample nos. 4-6 that include 2.5% regenerated cellulose having a 0.54 denier and 4.0 mm fiber length (Softray® regenerated cellulose fibers) as: TS7 value≤0.0066×GMT+8.0752, wherein the GMT is between about 700 g/3" to about 1300 g/3". As shown by the trend lines created for sample nos. 7-9 that had 5% regenerated cellulose having a 0.54 denier and 4.0 mm fiber length (Softray® regenerated cellulose fibers) and sample nos. 10-12 that had 10% regenerated cellulose having a 0.54 denier and 4.0 mm fiber length (Softray® regenerated cellulose fibers) will also have a TS7 value that is less than or equal to such an equation at a given GMT within the designated range of GMT values as the strength-softness curves for sample nos. 7-9 and sample nos. 10-12 are shifted to the right and down of the strength-softness curve for sample nos. 4-6. Similarly, for FIG. 2, an equation for calculating the TS750 value can be generated based on the trend line provided by sample nos. 4-6 that include 2.5% regenerated cellulose having a 0.54 denier and 4.0 mm fiber length (Softray® regenerated cellulose fibers) as: TS750 value≤0.021×GMT+42.663, wherein the GMT is between about 700 g/3" to about 1300 g/3". As shown by the trend lines created for sample nos. 7-9 that had 5% regenerated cellulose having a 0.54 denier and 4.0 mm fiber length (Softray® regenerated cellulose fibers) and sample nos. 10-12 that had 10% regenerated cellulose having a 0.54 denier and 4.0 mm fiber length (Softray® regenerated cellulose fibers) will also have a TS7 value that is less than or equal to such an equation at a given GMT within the designated range of GMT values as the strength-softness curves for sample nos. 7-9 and sample nos. 10-12 are shifted to the right and down of the strength-softness curve for sample nos. 4-6.

Figure 3:
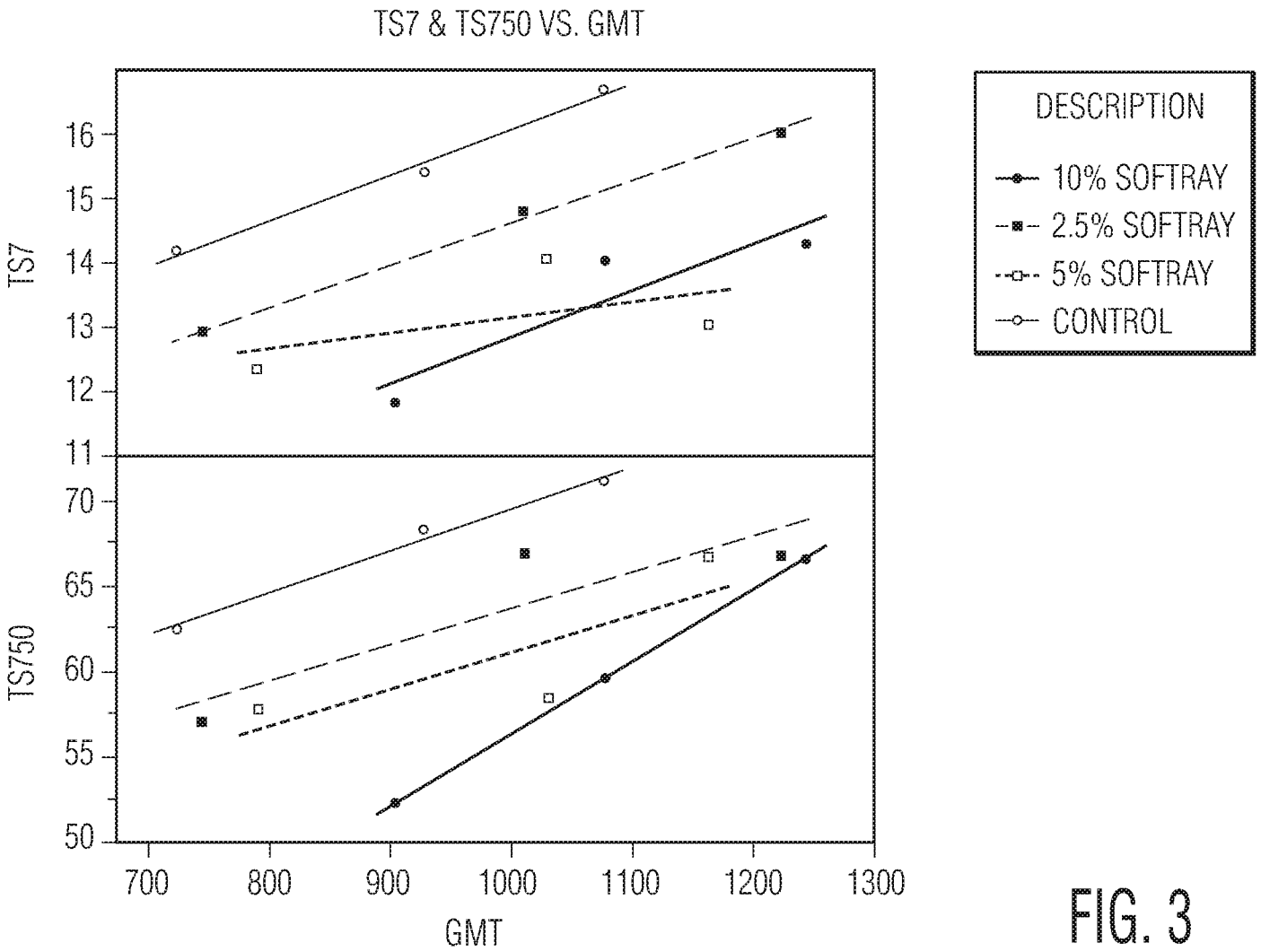
FIG. 3 is a graph illustrating TS7 Softness values and TS750 Softness values versus GMT values for various samples including different amounts of regenerated cellulose fibers as described herein.

FIG. 3 illustrates that adding a greater amount of regenerated cellulose fibers to the wet-laid tissue product (based on total weight of the wet-laid tissue product) can further improve the strength-softness curve. FIG. 3 depicts the samples of wet-laid tissue products including 2.5%, 5%, and 10% of regenerated cellulose fibers having a 0.54 denier and 4.0 mm fiber length (Softray® regenerated cellulose fibers) and their respective TS7 and TS750 values versus GMT values in comparison to the control code samples 1-3. As the amount of the regenerated cellulose fibers increases in the wet-laid tissue product, the TS7 and the TS750 values decrease. In other words, the greater the amount of regenerated cellulose fibers that are included in the wet-laid tissue product provide increased softness at a given strength. Referring to this relationship in another way, the greater the amount of regenerated cellulose fibers that are included in the wet-laid tissue product provide increased strength at a given softness.

Figure 4:
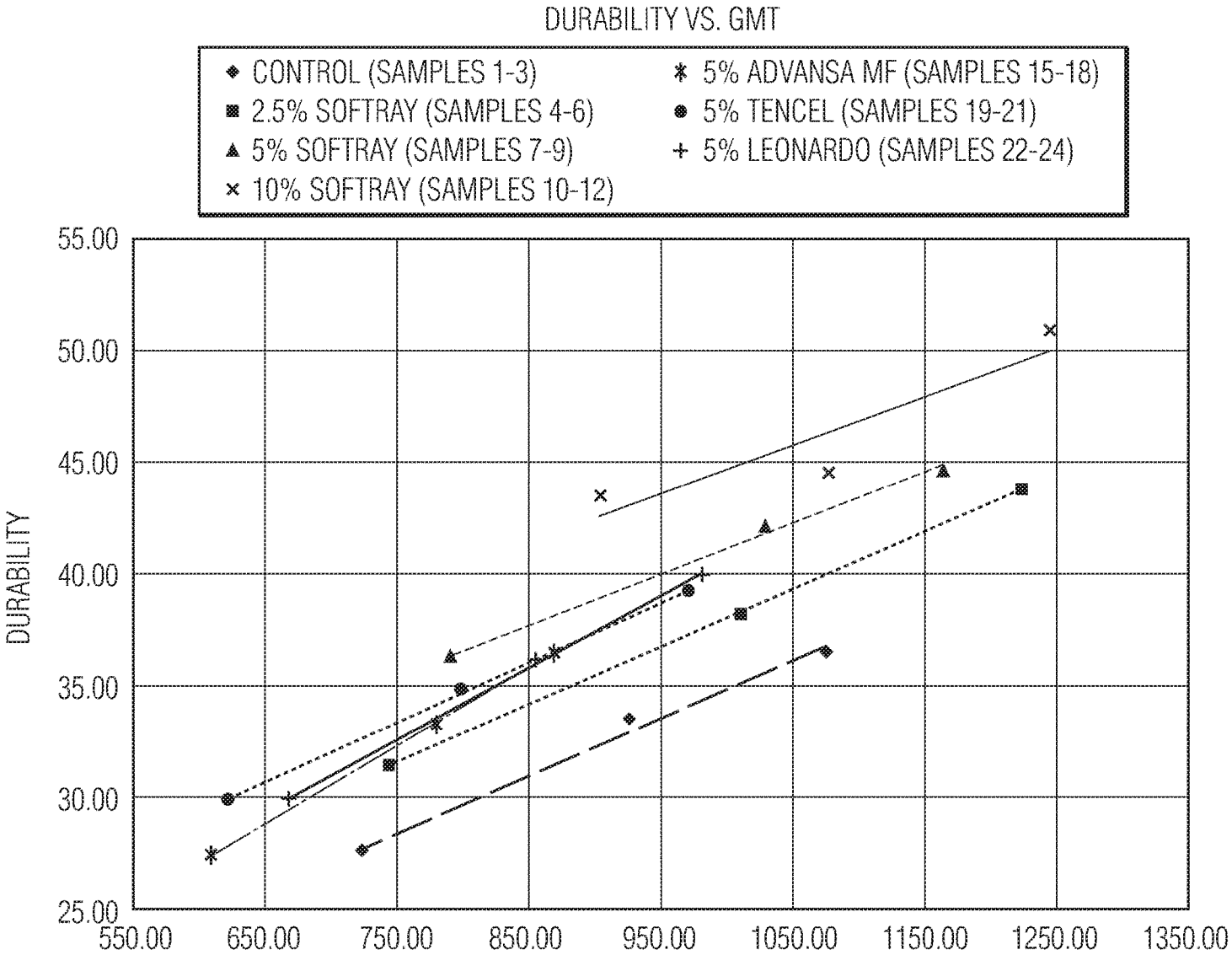
FIG. 4 is a graph illustrating Durability values versus GMT values for various samples including regenerated cellulose fibers as described herein.

The durability of the wet-laid tissue product samples including regenerated cellulose was also improved over the control code. As documented in Table 2 and as depicted in FIG. 4, a wet-laid tissue product sample including regenerated cellulose fibers can include a durability of greater than 30 for a GMT between 700 g/3" and 1300 g/3". More preferably, the durability for the wet-laid tissue product can be greater than 35 for a GMT between 700 g/3" and 1300 g/3", and even more preferably, the durability for the wet-laid tissue product can be greater than 40 for a GMT between 700 g/3" and 1300 g/3". As depicted in FIG. 4, the samples including the regenerated cellulose fibers having a 0.54 denier and 4.0 mm fiber length (Softray® regenerated cellulose fibers) provided a significant increase in durability as compared to the other comparative regenerated cellulose fibers and PET microfibers.

Figure 5:
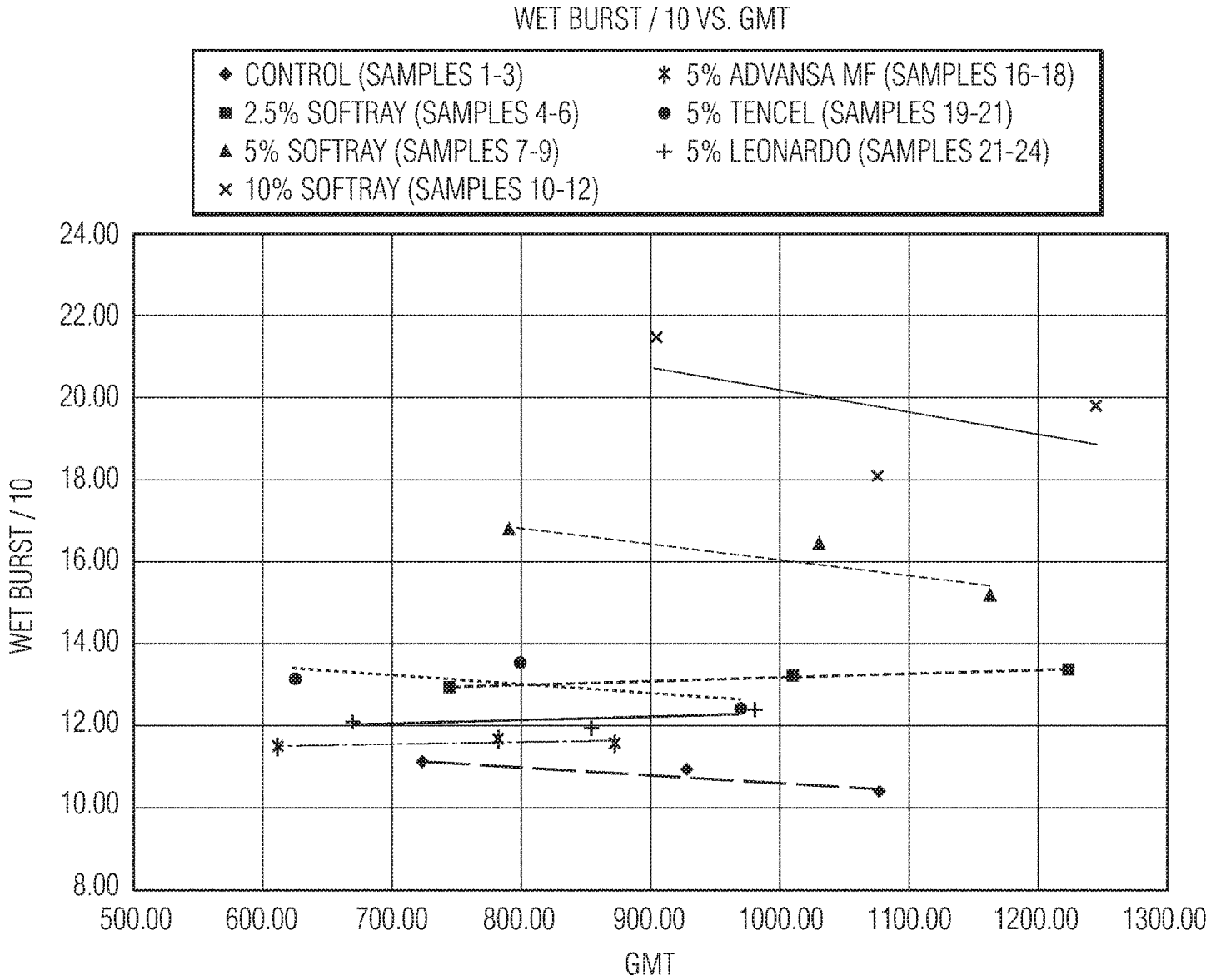
FIG. 5 is a graph illustrating Wet Burst values versus GMT values for various samples including regenerated cellulose fibers as described herein.

Additionally, the wet burst of the wet-laid tissue product samples including regenerated cellulose improved in comparison to the control codes. As documented in Table 2 and as depicted in FIG. 5, a wet-laid tissue product sample including regenerated cellulose fibers can include a wet burst of greater than 12.0 for a GMT between 700 g/3" and 1300 g/3", more preferably a wet burst of greater than 15.0 for a GMT between 700 g/3" and 1300 g/3", and even more preferably a wet burst of greater than 18.0 for a GMT between 700 g/3" and 1300 g/3". As depicted in FIG. 5, the samples including the regenerated cellulose fibers having a 0.54 denier and 4.0 mm fiber length (Softray® regenerated cellulose fibers) provided a significant increase in wet burst as compared to the other comparative regenerated cellulose fibers and PET microfibers.

Tables 3 and 4 below illustrate testing that produced a variety of wet-laid tissue products through a creped tissue making process referred to as a 2-ply conventional wet pressed process (referred to herein as "CTEC"), as described in U.S. Pat. No. 9,976,260, the contents of which are incorporated herein in a manner consistent with the present disclosure. Table 3 provides information regarding various facial tissue samples that were composed for testing that included NBSK, EHWK, and in some embodiments, RCF. As documented in Table 3, samples 110-118 comprised a blended sheet structure, meaning the sheet structure has a substantially homogeneous distribution of fibers throughout the z-direction of the sheet. Sample nos. 125-133 provide a layered structure including two outer plies and an inner ply. Table 4 provides various calculated and/or measured properties of the samples noted in Table 3. The regenerated cellulose fibers used in the CTEC samples described below in Tables 3 and 4 were Danufill KS regenerated cellulose fibers having a 0.45 denier (0.5 dtex) and fiber length of 3.0 mm, available from Kelheim Fibers GmbH (Kelheim, Germany).

TABLE 3

Wet-pressed, Wet-laid Sample Descriptions

| Sample | Figure Label | Sheet Structure | NBSK | EHWK | RCF | RCF Location | Amphoteric Starch | Kymene Wet Strength Resin |
|---|---|---|---|---|---|---|---|---|
| 110 | Control(B) | Blended | 25 | 75 | 0 | n/a | 0 | 2 |
| 111 | | Blended | 25 | 75 | 0 | n/a | 2.5 | 2 |
| 112 | | Blended | 25 | 75 | 0 | n/a | 6 | 2 |
| 113 | 5% RCF(B) | Blended | 25 | 70 | 5 | n/a | 0 | 2 |
| 114 | | Blended | 25 | 70 | 5 | n/a | 2.5 | 2 |
| 115 | | Blended | 25 | 70 | 5 | n/a | 6 | 2 |
| 116 | 10% RCF(B) | Blended | 25 | 65 | 10 | n/a | 0 | 2 |
| 117 | | Blended | 25 | 65 | 10 | n/a | 2.5 | 2 |
| 118 | | Blended | 25 | 65 | 10 | n/a | 6 | 2 |
| 125 | Control(L) | Layered | 15 | 85 | 0 | n/a | 0 | 2 |
| 126 | | Layered | 15 | 85 | 0 | n/a | 2.5 | 2 |
| 127 | | Layered | 15 | 85 | 0 | n/a | 6 | 2 |
| 128 | 5% RCF Both (L) | Layered | 15 | 80 | 5 | Both outer layers | 0 | 2 |
| 129 | | Layered | 15 | 80 | 5 | Both outer layers | 2.5 | 2 |
| 130 | | Layered | 15 | 80 | 5 | Both outer layers | 6 | 2 |
| 131 | 5% RCF Dryer (L) | Layered | 15 | 80 | 5 | Dryer side layer | 0 | 2 |
| 132 | | Layered | 15 | 80 | 5 | Dryer side layer | 2.5 | 2 |
| 133 | | Layered | 15 | 80 | 5 | Dryer side layer | 6 | 2 |

TABLE 4

Various Properties of Wet-pressed, Wet-laid Tissue Samples Described in Table 3.

| Sample No. | GMT | GM TEA | GM TEAR | Durability | Wet Burst/10 | TS7 Softness | SDF | DSF |
|---|---|---|---|---|---|---|---|---|
| 110 | 598.17 | 6.77 | 9.74 | 23.10 | 6.60 | 9.50 | 0.82 | 1.22 |
| 111 | 928.77 | 9.84 | 11.28 | 28.31 | 7.19 | 12.24 | 0.87 | 1.16 |
| 112 | 1159.16 | 12.14 | 13.97 | 33.16 | 7.05 | 13.42 | 0.81 | 1.24 |
| 113 | 721.26 | 7.92 | 12.18 | 32.27 | 12.17 | 10.45 | 0.65 | 1.54 |
| 114 | 894.01 | 9.60 | 14.13 | 35.10 | 11.37 | 12.59 | 0.72 | 1.39 |
| 115 | 1099.53 | 11.72 | 14.76 | 37.10 | 10.62 | 13.01 | 0.70 | 1.43 |
| 116 | 741.29 | 8.30 | 13.62 | 39.42 | 17.50 | 10.89 | 0.55 | 1.81 |
| 117 | 950.20 | 10.62 | 14.25 | 41.35 | 16.48 | 11.99 | 0.58 | 1.72 |
| 118 | 1105.24 | 12.31 | 16.56 | 44.61 | 15.73 | 12.90 | 0.58 | 1.73 |
| 125 | 811.50 | 6.84 | 11.19 | 30.85 | 12.83 | 9.16 | 0.89 | 1.12 |
| 126 | 1097.17 | 9.48 | 12.48 | 34.00 | 12.05 | 10.20 | 0.90 | 1.11 |
| 127 | 1323.38 | 10.58 | 13.55 | 38.47 | 14.35 | 11.47 | 0.89 | 1.12 |
| 128 | 837.82 | 7.76 | 12.06 | 38.74 | 18.92 | 8.59 | 0.67 | 1.50 |
| 129 | 1117.70 | 9.86 | 16.68 | 46.48 | 19.94 | 9.40 | 0.61 | 1.65 |
| 130 | 1414.38 | 12.56 | 17.02 | 48.14 | 18.57 | 10.37 | 0.65 | 1.55 |
| 131 | 952.31 | 6.95 | 12.26 | 39.55 | 20.33 | 8.58 | 0.65 | 1.54 |
| 132 | 1237.67 | 9.62 | 14.41 | 42.66 | 18.63 | 9.14 | 0.64 | 1.56 |
| 133 | 1479.57 | 11.25 | 17.05 | 45.07 | 16.77 | 9.83 | 0.65 | 1.53 |

Figure 6:
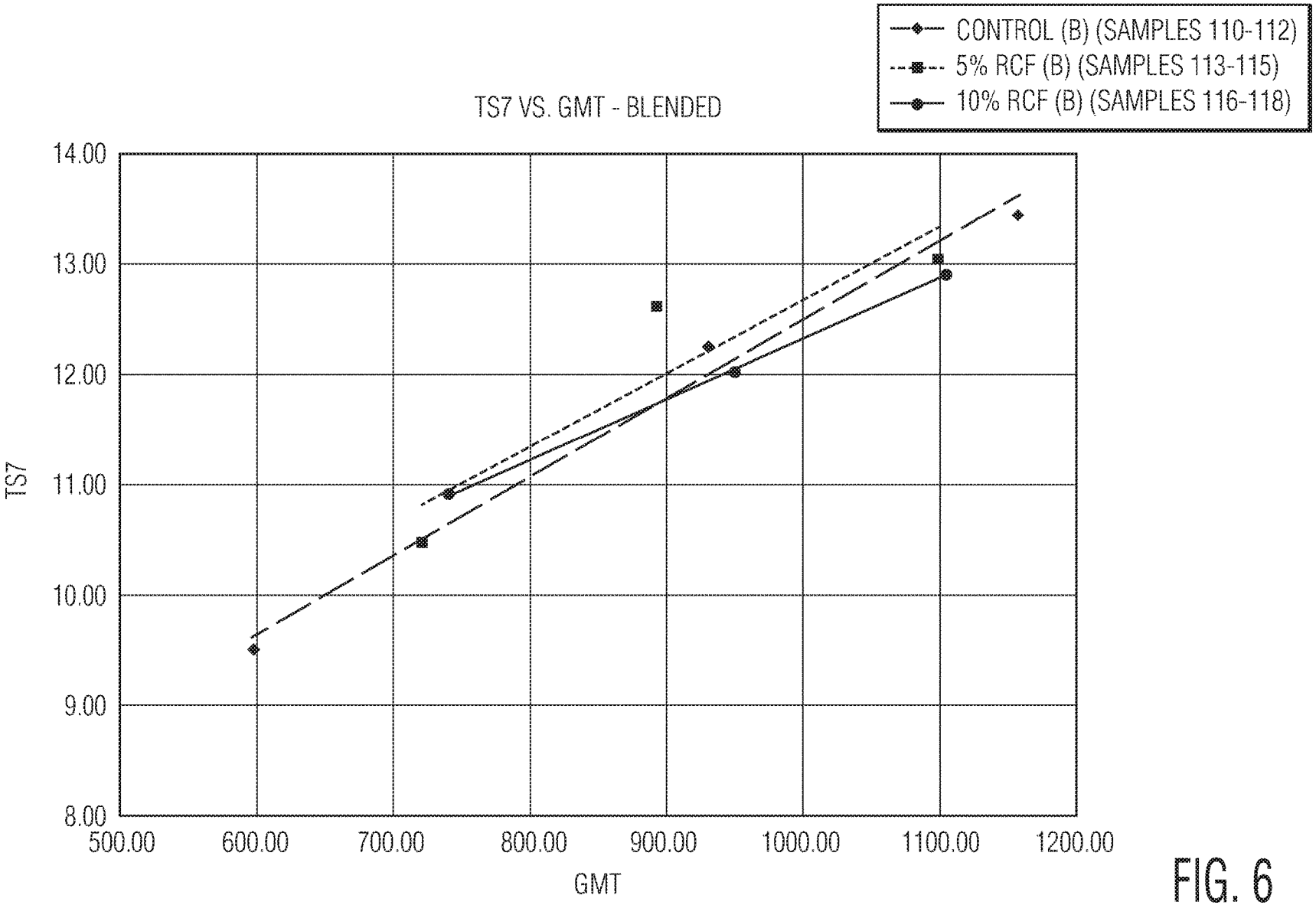
FIG. 6 is a graph illustrating TS7 Softness values versus GMT values for various samples including regenerated cellulose fibers as described herein.
Figure 7:
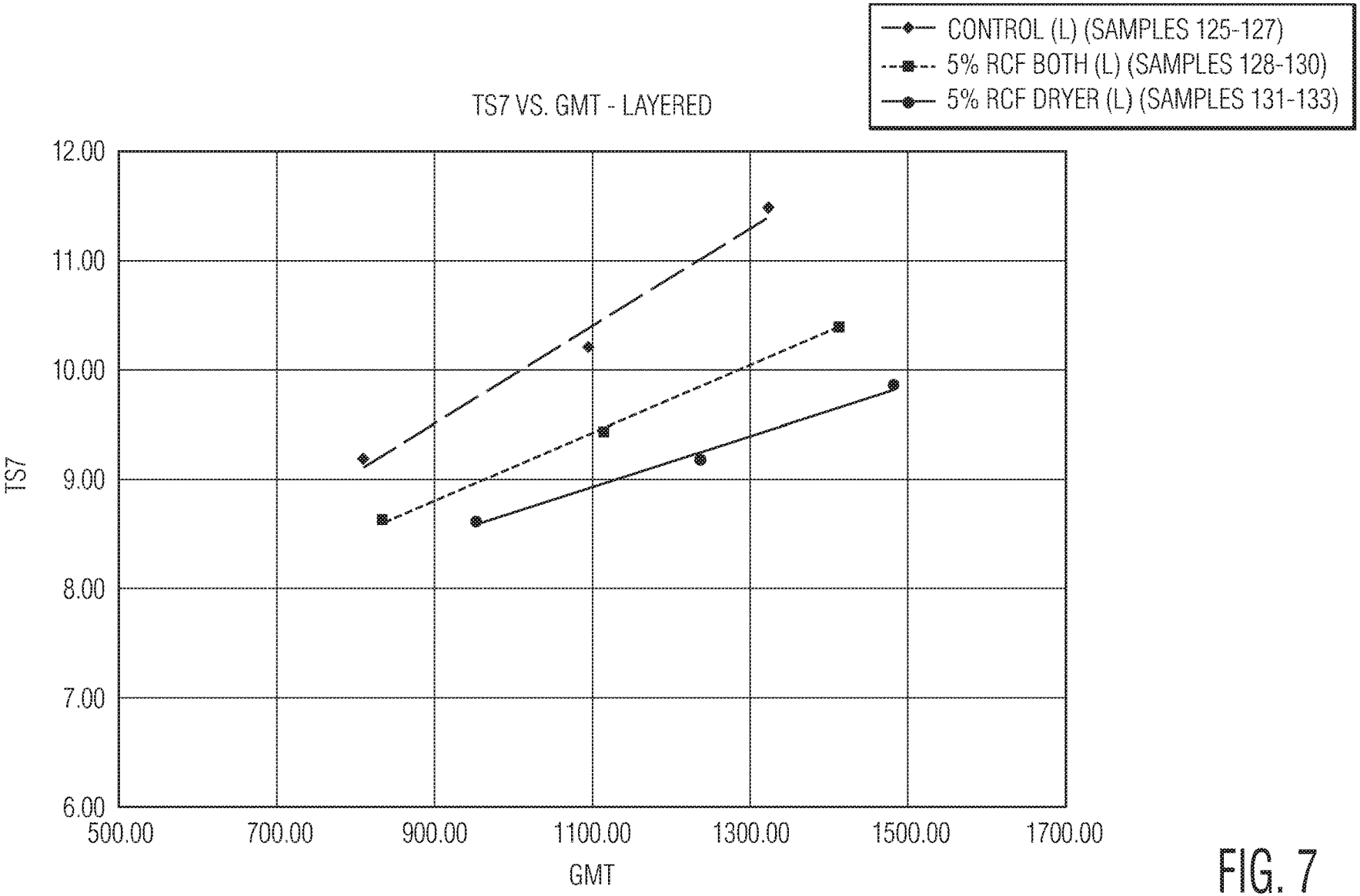
FIG. 7 is a graph illustrating TS7 Softness values versus GMT values for various samples including regenerated cellulose fibers as described herein.

FIGS. 6 and 7 demonstrate TS7 values vs. GMT of the wet-pressed, wet-laid tissue products as documented in Table 4, with FIG. 6 being directed to the blended codes (samples 110-118) and FIG. 7 being directed to the layered codes (samples 125-133). As depicted in FIG. 6, the wet-laid tissue products including regenerated cellulose fibers in place of EHWK fibers provided softness and strength generally at parity with the wet-laid tissue products not including any regenerated cellulose fibers. For the layered codes illustrated in FIG. 7, the samples including regenerated cellulose fibers in place of EHWK fibers provided beneficial softness at a given strength as compared to the control samples. In other words, the wet-laid tissue products including regenerated cellulose fibers in place of EHWK fibers shift the strength-softness curve to the right by providing increased strength at a given softness, or alternatively, increased softness at a given strength.

As documented in Table 4 and depicted in FIGS. 6 and 7, the wet-pressed, wet-laid tissue products including regenerated cellulose fibers can include a GMT greater than 700.0 g/3", more preferably greater than 800.0 g/3", and even more preferably greater than 900.0 g/3". The wet-laid tissue products including regenerated cellulose fibers can include a TS7 value of less than 14.00.

In particular, the TS7 values illustrated for the layered, wet-pressed, wet-laid tissue samples from FIG. 7 can be quantified in terms of a given GMT for samples including regenerated cellulose fibers. For example, an equation for calculating the TS7 value can be less than the trend line provided by control samples nos. 125-127, as TS7 value<0.0045×GMT+5.4458, wherein the GMT value is between about 600 g/3" to about 1500 g/3". FIG. 7 illustrates, that for the layered, wet-pressed, wet-laid tissue product samples that depositing the regenerated cellulose fibers in the dryer side layer in comparison to each of the outer layers provided an increase in the benefit of softness at a given strength. For example, improved softness properties were achieved by samples 131-133 that included the 5% regenerated cellulose fibers in the dryer side layer of the product in comparison to samples 128-130 that included the 5% regenerated cellulose fibers in both outer layers of the product.

Figure 8:
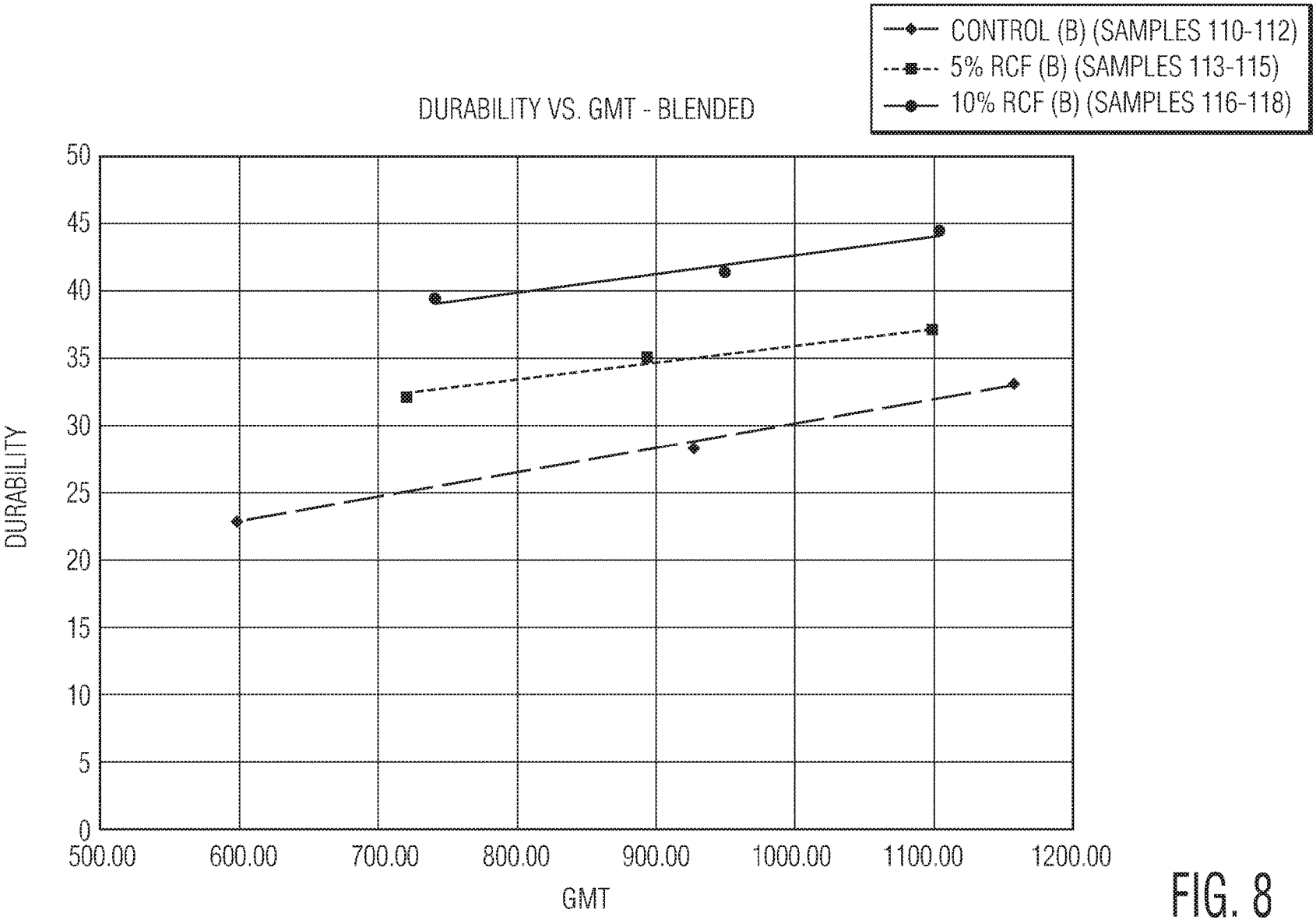
FIG. 8 is a graph illustrating Durability values versus GMT values for various samples including regenerated cellulose fibers as described herein.
Figure 9:
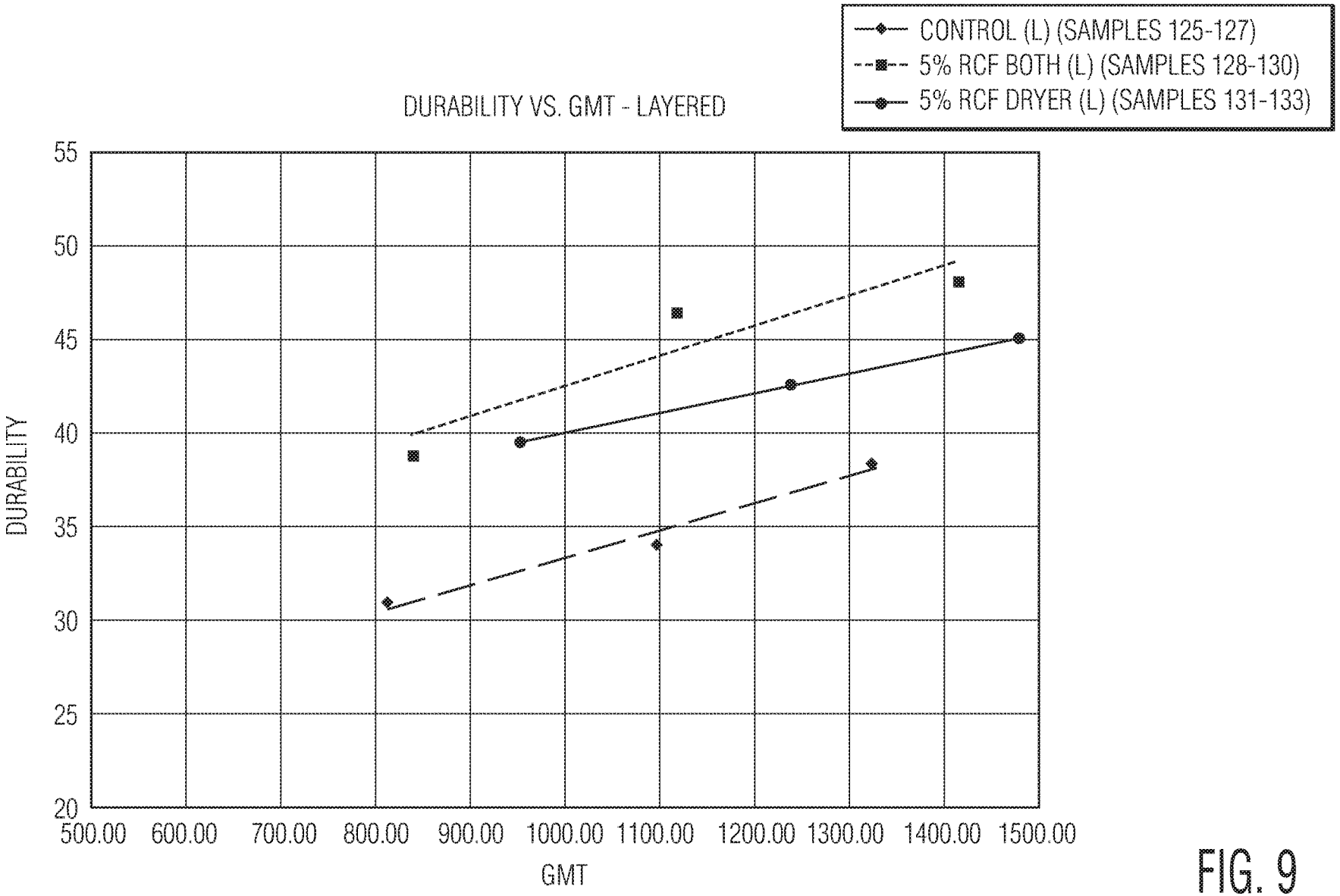
FIG. 9 is a graph illustrating Durability values versus GMT values for various samples including regenerated cellulose fibers as described herein.

The durability of the wet-pressed, wet-laid tissue product samples including regenerated cellulose was also improved over the control codes not including regenerated cellulose fibers. As documented in Table 4 and as depicted in FIGS. 8 and 9, a wet-pressed, wet-laid tissue product samples including regenerated cellulose fibers improve the durability at a given strength, and such durability can be improved by adding an increasing amount of regenerated cellulose fibers. For example, an equation for calculating the durability value at a given strength for a blended, wet-pressed, wet-laid tissue sample can be calculated as greater than the trend line provided by control sample nos. 110-112 in FIG. 8, as durability value>0.0178×GMT+12.268, wherein the GMT is between about 600 g/3" to about 1300 g/3". Similarly, an equation for calculating the durability value at a given strength for a layered, wet-pressed, wet-laid tissue sample can be calculated as greater than the trend line provided by control sample nos. 125-127 in FIG. 9, as durability value>0.00147×GMT+18.583, wherein the GMT is between about 600 g/3" to about 1500 g/3".

The benefits of the improved durability and softness of the wet-pressed, wet-laid tissue products can also be quantified by a Durability Softness Factor ("DSF") value. As used herein, a DSF value is a factor calculated by: [durability value/TS7 softness value]/number of plies of the wet-laid tissue product. Table 4 provides all of the DSF values for all of the wet-pressed, wet-laid tissue products created in Table 3. In general, a higher DSF value will provide a product with increased durability and/or increased softness. As documented herein, the wet-pressed, wet-laid tissue products including regenerated cellulose fibers can include a DSF value can be greater than 1.22, more preferably greater than 1.25, more preferably greater than 1.30, more preferably greater than 1.35, more preferably greater than 1.40, more preferably greater than 1.45, and even more preferably greater than 1.50. All of the control codes, for both blended and layered executions of wet-pressed, wet-laid, tissue samples exhibited a DSF ratio of 1.22 or less.

In a similar fashion, a Softness Durability Factor ("SDF") value was also calculated for all of the wet-pressed, wet-laid tissue products created herein. The SDF value is a factor that is the inverse of the DSF value, or in other words, is calculated by [TS7 softness value/durability value]/number of plies of the wet-laid tissue product. In general, a lower SDF value will provide a product with increased softness and/or increased durability. As documented herein, the wet-pressed, wet-laid tissue products including regenerated cellulose fibers can include a SDF value can be less than 0.81, more preferably less than 0.80, more preferably less than 0.75, more preferably less than 0.70, more preferably less than 0.65, and even more preferably less than 0.60.

Figure 10:
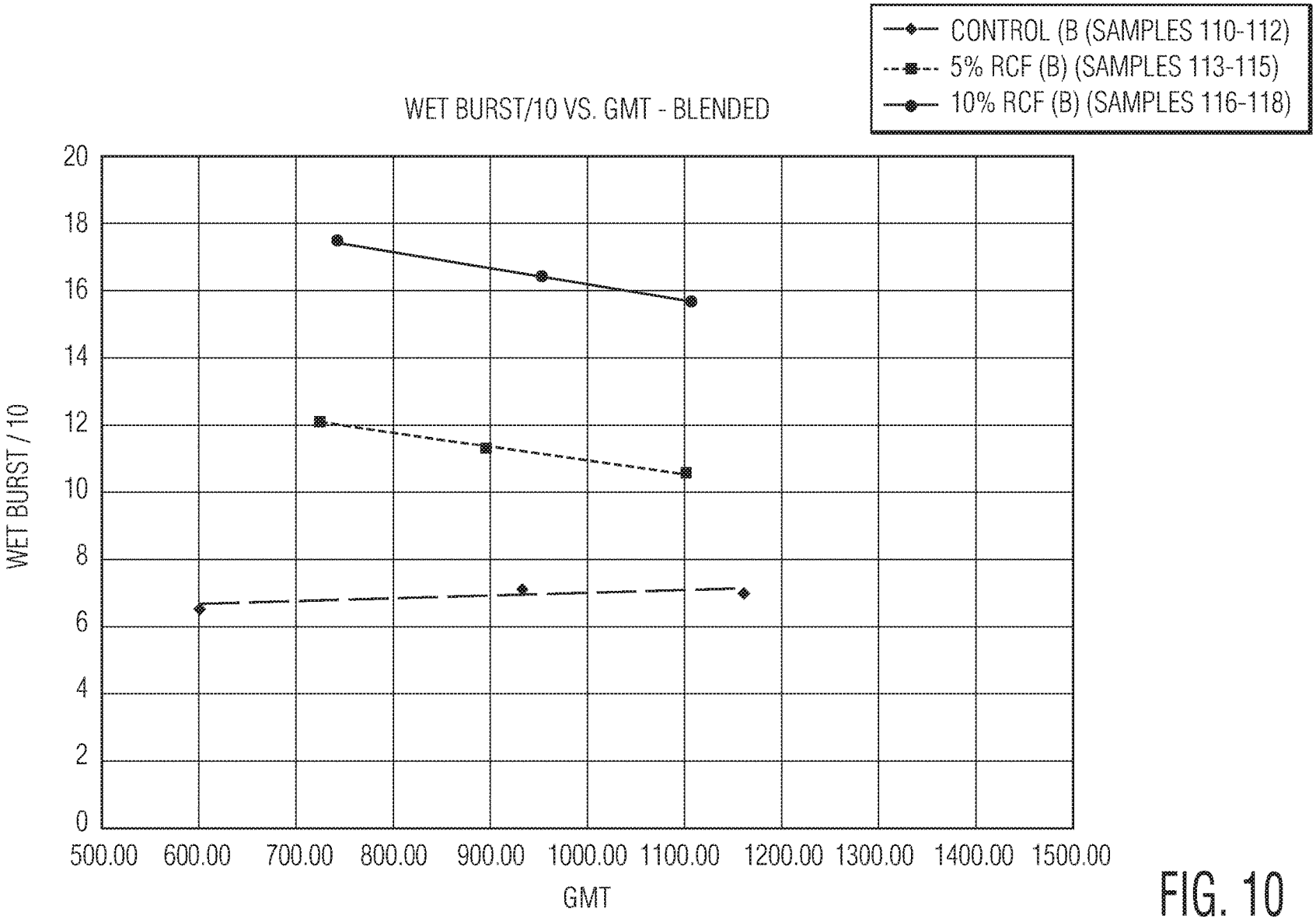
FIG. 10 is a graph illustrating Wet Burst/10 values versus GMT values for various samples including regenerated cellulose fibers as described herein.
Figure 11:
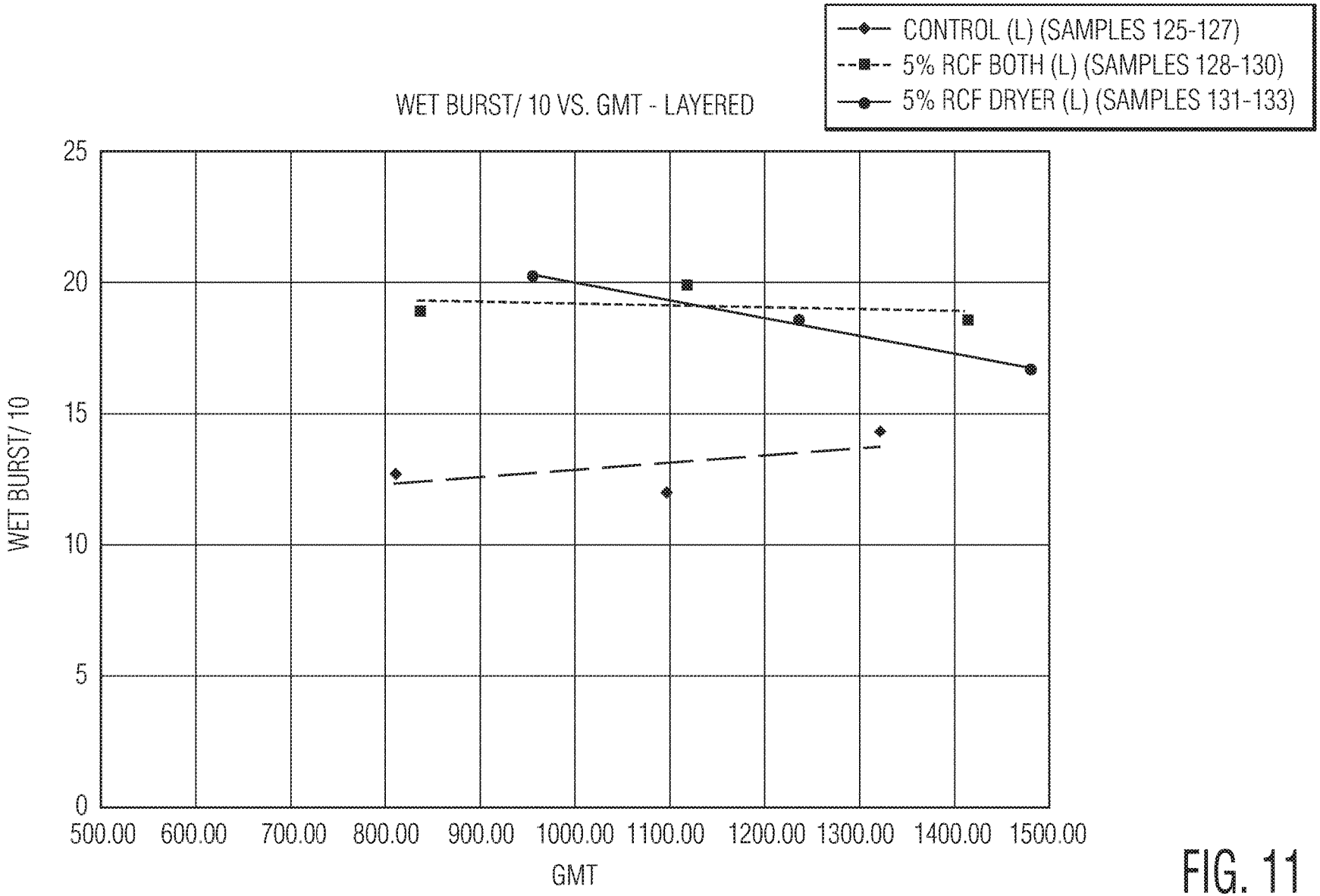
FIG. 11 is a graph illustrating Wet Burst/10 values versus GMT values for various samples including regenerated cellulose fibers as described herein.

Additionally, the wet burst of the wet-pressed, wet-laid tissue product samples including regenerated cellulose fibers improved in comparison to the control codes. As documented in Table 4 and as depicted in FIG. 10, a blended, wet-pressed, wet-laid tissue product sample including regenerated cellulose fibers can include a wet burst/10 value of greater than 8.0 for a GMT between 600 g/3" and 1300 g/3", more preferably a wet burst/10 value of greater than 10.0 for a GMT between 600 g/3" and 1300 g/3", and even more preferably a wet burst/10 value of greater than 14.0 for a GMT between 600 g/3" and 1300 g/3". As documented in Table 4 and as depicted in FIG. 11, a layered, wet-pressed, wet-laid tissue product sample including regenerated cellulose fibers can include a wet burst/10 value of greater than 15.0 for a GMT between 600 g/3" and 1500 g/3", more preferably a wet burst/10 value of greater than 16.0 for a GMT between 600 g/3" and 1500 g/3", and even more preferably a wet burst/10 value of greater than 17.0 for a GMT between 600 g/3" and 1500 g/3".

Without being bound by theory, it is believed that the fine regenerated cellulose fibers have a reduced capacity for hydrogen bonding relative to natural cellulose fibers, but that the fine fibers add strength to the sheet through physical forces such as friction and/or entanglement, in addition to a low level of hydrogen bonding. While hydrogen bonding tends to substantially increase sheet stiffness and grittiness, the alternative strength mechanism of the fine regenerated cellulose fibers is thought to increase strength with much lower impact on stiffness and grittiness. In other words, fine regenerated cellulose fibers shift the strength-softness curve to the right, by increasing the strength without hurting softness.

The wet-laid tissue product including regenerated cellulose fibers may be provided in a configuration including only a singly ply, or may be provided in a product including multiple plies. In an embodiment including multiple plies, the product can include regenerated cellulose fibers in one ply or can include regenerated cellulose fibers in more than one ply. In an embodiment including multiple plies, the wet-laid tissue product can include regenerated cellulose fibers within at least one outer ply of the multiple plies, and more preferably, with each of the outer plies. It should be understood that, when referring to a layer that is substantially free of regenerated cellulose fibers, negligible amounts of such fiber may be present therein, however, such small amounts often arise from the regenerated cellulose fibers applied to an adjacent layer, and do not typically substantially affect the softness or other physical characteristics of the web. In some embodiments, the wet-laid tissue product may comprise two multi-layered through-air dried webs wherein each web comprises a first fibrous layer substantially free from regenerated cellulose fibers and a second fibrous layer comprising regenerated cellulose fibers. The webs can be plied together such that the outer surface of the tissue product is formed from the second fibrous layer of each such that the second fibrous layer comprising the regenerated cellulose fibers can provide enhanced softness as the outer layer is intended to be brought into contact with the user's skin in-use.

In some embodiments, the regenerated cellulose fibers can provide 25% or less, or in some embodiments 20% or less, or in some embodiments 15% or less of the total weight of the wet-laid tissue product. In a particularly preferred embodiment regenerated cellulose fibers are utilized in the tissue web as a replacement for high fiber length wood fibers such as softwood fibers, and more specifically, NBSK fibers. In one particular embodiment the regenerated cellulose fibers are substituted for at least 2.0%, more preferably at least 2.5%, even more preferably at least 4.0%, and yet even more preferably at least 5.0% of the NBSK fibers.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 60 pounds per ton (lbs/T), in some embodiments, between about 5 to about 30 lbs/T, and in some embodiments, between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and uncreped. When forming multi-ply tissue products, the separate plies can be made from the same process or from different processes as desired.

TEST METHODS

TS7 and TS750

TS7 and TS750 values were measured using an EMTEC Tissue Softness Analyzer ("TSA") (Emtec Electronic GmbH, Leipzig, Germany) and are the average of ten repeated measurements. The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against sample with a load of 100 mN and the rotational speed of the blades is 2 revolutions per second.

To measure TS7 and TS750 values two different frequency analyses are performed. The first frequency analysis is performed in the range of approximately 200 Hz to 1000 Hz, with the amplitude of the peak occurring at 750 Hz being recorded as the TS750 value. The TS750 value represents the surface smoothness of the sample. A high amplitude peak correlates to a rougher surface. A second frequency analysis is performed in the range from 1 to 10 kHZ, with the amplitude of the peak occurring at 7 kHz being recorded as the TS7 value. The TS7 value represents the softness of sample. A lower amplitude correlates to a softer sample. Both TS750 and TS7 values have the units dB V2 rms.

To measure the stiffness properties of the test sample, the rotor is initially loaded against the sample to a load of 100 mN. Then, the rotor is gradually loaded further until the load reaches 600 mN. As the sample is loaded the instrument records sample displacement (μm) versus load (mN) and outputs a curve over the range of 100 to 600 mN. The modulus value "E" is reported as the slope of the displacement versus loading curve for this first loading cycle, with units of mm displacement/N of loading force. After the first loading cycle from 100 to 600 mN is completed, the instrument reduces the load back to 100 mN and then increases the load again to 600 mN for a second loading cycle. The slope of the displacement versus loading curve from the second loading cycle is called the "D" modulus value.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006") in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single-ply basesheet. This is done by multiplying the single-ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Wet Burst Strength

Wet Burst Strength is measured using an EJA Burst Tester (series #50360, commercially available from Thwing-Albert Instrument Company, Philadelphia, Pa.). The test procedure is according to TAPPI T570 pm-00 except the test speed. The test specimen is clamped between two concentric rings whose inner diameter defines the circular area under test. A penetration assembly, the top of which is a smooth, spherical steel ball, is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 inches (15.88±0.05 mm) finished spherical to 0.00004 inches (0.001 mm). The spherical penetration member is permanently affixed to the end of a 0.375±0.010 inches (9.525±0.254 mm) solid steel rod. A 2000 gram load cell is used and 50 percent of the load range i.e. 0-1000 g is selected. The distance of travel of the probe is such that the upper most surface of the spherical ball reaches a distance of 1.375 inches (34.9 mm) above the plane of the sample clamped in the test. A means to secure the test specimen for testing consisting of upper and lower concentric rings of approximately 0.25 inches (6.4 mm) thick aluminum between which the sample is firmly held by pneumatic clamps operated under a filtered air source at 60 psi. The clamping rings are 3.50±0.01 inches (88.9±0.3 mm) in internal diameter and approximately 6.5 inches (165 mm) in outside diameter. The clamping surfaces of the clamping rings are coated with a commercial grade of neoprene approximately 0.0625 inches (1.6 mm) thick having a Shore hardness of 70-85 (A scale). The neoprene needs not cover the entire surface of the clamping ring but is coincident with the inner diameter, thus having an inner diameter of 3.50±0.01 inches (88.9±0.3 mm) and is 0.5 inches (12.7 mm) wide, thus having an external diameter of 4.5±0.01 inches (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Samples are conditioned under TAPPI conditions and cut into 127×127 mm±5 mm squares. Samples are then wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

Fiber Length

Tissue samples are prepared and stained as set forth in TAPPI T 401, which provides for the identification of the types of fibers present in a sample and their quantitative estimation. If the tissue sample includes more than one cellulosic fiber type, the different fiber types will accept the stain in a different fashion to allow identification of the particular fiber type(s) to be analyzed. The stained sample is then analyzed using an image analysis system to determine fiber length.

The image analysis system includes a computer having a frame grabber board, a stereoscope, a video camera, and image analysis software. A VH5900 monitor microscope and a video camera having a VH50 lens with a contact type illumination head, available from the Keyence Company of Fair Lawn, N.J., can be used. The stereoscope and video camera acquire the image to be recorded. The frame grabber board converts the analog signal of this image to a digital format readable by the computer.

The image saved to the computer file is measured using suitable software such as the Optimas Image Analysis software, version 3.0, available from the BioScan Company of Edmonds, Wash.

The slide is placed on the stereoscope stage. The stereoscope is adjusted to a 15× magnification level. The stereoscope light source intensity is set to the maximum value, and the stereoscope aperture is set to the minimum aperture size in order to obtain the maximum image contrast. The Optimas software is run with the multiple mode set and ARAREA (area) and ARLENGTH (length) measurements selected.

Under "Sampling Options," the following default values are used: sampling units are selected, set number equals 64 intervals, and minimum boundary length is 10 samples. The following options are not selected: Remove Areas Touching Region of Interest (ROI), Remove Areas Inside Other Areas, and Smooth Boundaries. The software contrast and brightness settings are set to 0 and 170, respectively. The software threshold settings are set to 125 and 255.

The image analysis software is calibrated in millimeters with a metric ruler placed in the field of view. The calibration is performed to obtain a screen width of 6.12 millimeters.

The region of interest is selected so that no fibers intersect the boundary of the region of interest. The operator positions the slide and acquires the image data (area and length) in one field. The slide is then repositioned, and image data are acquired in a second field. Data collection is continued until data from the entire slide is acquired. The use of grid lines on the slide, while not essential, is highly useful to prevent the microscopist from missing an area or reading an area more than once. Fibers crossing the grid lines are not included in the data collection.

While it is desirable to have a slide composed solely of individual fibers which do not cross, inevitably some images comprised of crossed fibers will be created. Crossed fiber images are deleted with the paint option available in the Optimas software if none of the crossed fibers are unobstructed. Unobstructed fibers in crossed fiber images are retained by painting over those fibers in the crossed fiber image which are at least partially obstructed by other fibers.

The image analysis software provides the projected fiber surface area and the fiber length for each fiber image recorded with the image analysis system.

EMBODIMENTS

While tissue webs, and wet-laid tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments.

Embodiment 1: A wet-laid tissue product comprising regenerated cellulose fibers providing 25% or less of the total weight of the wet-laid tissue product, the regenerated cellulose fibers comprising a denier of less than 0.9 and a fiber length of less than 6.0 mm.

Embodiment 2: The wet-laid tissue product of embodiment 1, wherein the denier is less than 0.7.

Embodiment 3: The wet-laid tissue product of embodiment 1 or 2, wherein the regenerated cellulose fibers include an average diameter of less than 10.0 μm.

Embodiment 4: The wet-laid tissue product of any one of the preceding embodiments, wherein the regenerated cellulose fibers provide between 0.1% to 10.0% of the total weight of the wet-laid tissue product.

Embodiment 5: The wet-laid tissue product of embodiment 4, wherein the regenerated cellulose fibers provide between 0.1% to 5.0% of the total weight of the wet-laid tissue product.

Embodiment 6: The wet-laid tissue product of any one of the preceding embodiments, further comprising *eucalyptus* fibers, wherein the *eucalyptus* fibers provide between 40% to 80% of the total weight of the wet-laid tissue product.

Embodiment 7: The wet-laid tissue product of any one of the preceding embodiments, further comprising NBSK fibers, wherein the NBSK fibers provide between 20% to 60% of the total weight of the wet-laid tissue product.

Embodiment 8: The wet-laid tissue product of any one of the preceding embodiments, wherein the wet-laid tissue product includes only a single ply.

Embodiment 9: The wet-laid tissue product of any one of embodiments 1-7, wherein the wet-laid tissue product includes multiple plies, and wherein the regenerated cellulose fibers are disposed within at least one outer ply of the multiple plies.

Embodiment 10: The wet-laid tissue product of any one of the preceding embodiments, wherein the wet-laid tissue product is through-air dried.

Embodiment 11: The wet-laid tissue product of any one of the preceding embodiments, further comprising a TS7 value≤0.0066×GMT+8.0752, wherein the GMT is between about 700 g/3" to about 1300 g/3".

Embodiment 12: The wet-laid tissue product of any one of the preceding embodiments, further comprising a TS750 value≤0.021×GMT+42.663, wherein the GMT is between about 700 g/3" to about 1300 g/3".

Embodiment 13: The wet-laid tissue product of any one of the preceding embodiments, further comprising a durability of greater than 30.

Embodiment 14: A wet-laid tissue product comprising regenerated cellulose fibers providing 25% or less of the total weight of the wet-laid tissue product and a TS7 value≤0.0066×GMT+8.0752, wherein the GMT is between about 700 g/3" to about 1300 g/3".

Embodiment 15: The wet-laid tissue product of embodiment 14, wherein the regenerated cellulose fibers comprise a denier of less than 0.9 and a fiber length of between about 1.4 mm to 6.0 mm.

Embodiment 16: The wet-laid tissue product of embodiment 14 or 15, wherein the regenerated cellulose fibers include an average diameter of less than 10.0 μm.

Embodiment 17: The wet-laid tissue product of any one of embodiments 14-16, wherein the regenerated cellulose fibers provide between 0.1% to 10.0% of the total weight of the wet-laid tissue product.

Embodiment 18: The wet-laid tissue product of any one of embodiments 14-17, further comprising a TS750 value≤0.021×GMT+42.663, wherein the GMT is between about 700 g/3" to about 1300 g/3".

Embodiment 19: A wet-laid tissue product comprising regenerated cellulose fibers providing 25% or less of the total weight of the wet-laid tissue product and a TS750 value≤0.021×GMT+42.663, wherein the GMT is between about 700 g/3" to about 1300 g/3".

Embodiment 20: The wet-laid tissue product of embodiment 19, wherein the regenerated cellulose fibers comprise a denier of less than 0.9 and a fiber length of less than 6.0 mm.

What is claimed is:

1. A wet-laid tissue product comprising regenerated cellulose fibers providing between 0.1% to 25% of the total weight of the wet-laid tissue product, the regenerated cellulose fibers comprising a denier between 0.1 to 0.9 and a fiber length of less than 6.0 mm; wherein the wet-laid tissue product comprises a durability of greater than 30 for a GMT between 700 g/3" and 1300 g/3".

2. The wet-laid tissue product of claim 1, wherein the denier is less than 0.7.

3. The wet-laid tissue product of claim 1, wherein the regenerated cellulose fibers include an average diameter of less than 10.0 μm.

4. The wet-laid tissue product of claim 1, wherein the regenerated cellulose fibers provide between 0.1% to 10.0% of the total weight of the wet-laid tissue product.

5. The wet-laid tissue product of claim 1, wherein the regenerated cellulose fibers provide between 0.1% to 5.0% of the total weight of the wet-laid tissue product.

6. The wet-laid tissue product of claim 1, further comprising *eucalyptus* fibers, wherein the *eucalyptus* fibers provide between 40% to 80% of the total weight of the wet-laid tissue product.

7. The wet-laid tissue product of claim 1, further comprising NBSK fibers, wherein the NBSK fibers provide between 20% to 60% of the total weight of the wet-laid tissue product.

8. The wet-laid tissue product of claim 1, wherein the wet-laid tissue product includes only a single ply.

9. The wet-laid tissue product of claim 1, wherein the wet-laid tissue product includes multiple plies, and wherein the regenerated cellulose fibers are disposed within at least one outer ply of the multiple plies.

10. The wet-laid tissue product of claim 1, wherein the wet-laid tissue product is through-air dried.

11. The wet-laid tissue product of claim 1, further comprising a TS7 value≤0.0066×GMT+8.0752, wherein the GMT is between about 700 g/3" to about 1300 g/3".

12. The wet-laid tissue product of claim 1, further comprising a TS750 value≤0.021×GMT+42.663, wherein the GMT is between about 700 g/3" to about 1300 g/3".

13. A wet-laid tissue product comprising regenerated cellulose fibers providing between 0.1% to 25% of the total weight of the wet-laid tissue product and a TS7 value≤0.0066×GMT+8.0752, wherein the GMT is between about 700 g/3" to about 1300 g/3", wherein the regenerated cellulose fibers comprise a denier between 0.1 to 0.9 and a fiber length of less than 6.0 mm.

14. The wet-laid tissue product of claim 13, wherein the regenerated cellulose fibers comprise a fiber length greater than 1.4 mm.

15. The wet-laid tissue product of claim 13, wherein the regenerated cellulose fibers include an average diameter of less than 10.0 μm.

16. The wet-laid tissue product of claim 13, wherein the regenerated cellulose fibers provide between 0.1% to 10.0% of the total weight of the wet-laid tissue product.

17. The wet-laid tissue product of claim 13, further comprising a TS750 value≤0.021×GMT+42.663, wherein the GMT is between about 700 g/3" to about 1300 g/3".

18. A wet-laid tissue product comprising regenerated cellulose fibers providing between 0.1% to 25% of the total weight of the wet-laid tissue product and a TS750 value≤0.021×GMT+42.663, wherein the GMT is between about 700 g/3" to about 1300 g/3", wherein the regenerated cellulose fibers comprise a denier between 0.1 to 0.9 and a fiber length of less than 6.0 mm.

* * * * *